United States Patent [19]

Bammert

[11] 4,350,480

[45] Sep. 21, 1982

[54] INTERMESHING SCREW ROTOR MACHINE WITH SPECIFIC THREAD PROFILE

[76] Inventor: Karl Bammert, Alleestrasse 3, 3000 Hanover, Fed. Rep. of Germany

[21] Appl. No.: 101,079

[22] Filed: Dec. 7, 1979

[30] Foreign Application Priority Data

Mar. 23, 1979 [DE] Fed. Rep. of Germany ..... 2911415

[51] Int. Cl.[3] ..... F01C 1/16; F04C 18/16; F16H 55/08

[52] U.S. Cl. ..... 418/201; 74/466

[58] Field of Search ..... 418/197, 201–203; 74/466

[56] References Cited

U.S. PATENT DOCUMENTS 2,486,770 11/1949 Whitfield ..... 418/201
3,414,189 12/1968 Persson ..... 418/201
3,423,017 1/1969 Schibbye ..... 418/201

FOREIGN PATENT DOCUMENTS 934605 10/1955 Fed. Rep. of Germany ..... 418/201
2419551 11/1975 Fed. Rep. of Germany ..... 418/201

*Primary Examiner*—John J. Vrablik
*Attorney, Agent, or Firm*—Toren, McGeady & Stanger

[57] ABSTRACT

The threads of the gate rotor of a screw rotor machine are generated by a rounded crest portion of the main rotor thread so that the flanks of the gate rotor threads will have a contour tangent to a plurality of circles which have progressively decreasing diameters taken from the radially innermost to the radially outermost of said circles, with the circles each having a center which lies on a curved radial line directed forwardly of the direction of rotation of the gate rotor when the machine is operated as a compressor. A crest portion of the gate rotor threads shaped in conformity with the radially outermost of said contour-defining plurality of circles has its center lying within and closely adjacent to the pitch circle of the gate rotor, with the gate rotor thread crest portion projecting beyond the gate rotor pitch circle a distance corresponding approximately to the radius of the radially outermost circle.

21 Claims, 15 Drawing Figures

INTERMESHING SCREW ROTOR MACHINE WITH SPECIFIC THREAD PROFILE

The present invention relates generally to screw rotor machines and more particularly to a machine having a pair of rotors each formed with helical threads thereon and intermeshing with each other within a housing defining intersecting parallel bores within which the rotors operate.

In the prior art, screw rotor machines of the type to which the present invention relates have designated the rotors as a main rotor and a gate rotor cooperating with each other within the walls of the parallel intersecting bores to define pockets for a working fluid moving from an inlet toward an outlet of the housing. In the type of screw rotor machine to which the present invention is related, the threads and grooves of the main rotor are located to lie substantially outside of the pitch circle of the main rotor and the main rotor threads are usually formed with a generally convex profile on leading and trailing flanks thereof. The threads and grooves of the gate rotor lie substantially inside a pitch circle of the gate rotor and the gate rotor threads are generally formed with concavely curved profiles on the leading and trailing flanks thereof.

In the description which follows, the terms "gate rotor" and "grooved rotor" will be used interchangeably.

Similarly, the terms "main rotor" and "ribbed rotor" will be used interchangeably.

A known prior art structure of a screw rotor machine of the type referred to above is known from German Auslegeschrift No. 25 05 113. In this structure, the contour of a gate rotor flank which defines the trailing side of a groove of the gate or grooved rotor is located outside of the pitch circle, i.e. in the region of the summit or crest of the rotor thread located between the rotor grooves, with this contour being generated by a straight section of the corresponding rotor thread of the main or rib rotor, with the generation of an edge which points or extends in the direction of rotation of the grooved or gate rotor. The contour of the thread flank which forms the leading side of the groove initially extends, from a point on the root portion of the rotor thread which is located in the groove closest to the axis, in the form of a circular arc having a center located at the point of intersection between a pitch circle radius extending through a point on the groove located in closest proximity to the axis and the pitch circle. The contour then extends radially in a straight line to the pitch circle and, subsequently, it extends in the form of a quarter circle which begins at the pitch circle into a cylindrical crest portion of the grooved rotor, which crest portion forms another edge together with the straight section of the contour of the trailing flank side of the groove. Spaces which correspond with the crest track sections are provided between the ribs of the main rotor, with the crest track section rolling on a circle arc-shaped bottom surface of each space.

As a result of this design, the advantages of a short sealing line and of small blow holes may be obtained in a manner similar to that achieved with a similarly constructed screw rotor machine disclosed in U.S. Pat. No. 3,414,189. However, it was intended that the difficulties and extensive manufacture of complicated geometric shapes of the threads and grooves of the screw rotor machine in accordance with U.S. Pat. No. 3,414,189 were to be avoided.

In German Auslegeschrift No. 25 05 113, in order to effect generation of a section of a groove beginning at a point on the contour of a crest flank representing the trailing side of the groove, which point is closest to the axis, a punctiform section of the contour of the thread of the main rotor, or a so-called "sharp edge", is used. This has the result that, on the one hand, a very small blow hole is formed. However, on the other hand, distribution of the wear to wider portions of the generating section does not occur as would usually be the case in the use of traveling points formed by rounding off these generating sections. The edge created by the straight section of the contour of the thread flank defining the trailing groove side is also not capable of appropriately distributing the wear. The relatively wide crest track sections of the threads which are located between the grooves and the corresponding threads of the ribbed or main rotor not only reduce the effecting working surface of the grooves of the gate or grooved rotor relative to the rotor diameter, but they also create significant sealing problems which are ostensibly prevented by means of additional sealing webs. However, these sealing webs make production more expensive and difficult and, depending upon the design of the webs, operation of the machine becomes more susceptible to difficulty.

It should be understood that in the disclosure which follows, it will be assumed that the screw rotor machine of the present invention is operated as a compressor which will determine leading and trailing flanks of the rotor threads and of the groove sides. However, it should be understood, that machines of this type may also be operated as motors or expanders, in which case reversal of the direction of rotation may occur.

SUMMARY OF THE INVENTION

The present invention is directed toward the task of providing a screw rotor machine which utilizes a wear-reducing generation of the contour of the thread flank forming the trailing side of the groove of the gate rotor by means of a rounded-off section of the threads of the main rotor through traveling points in order to make it possible to maintain the blow holes about as was heretofore achievable only by use of edges which are more or less "sharp". The shape of the groove and the thread contours may in this case be adjusted to the desired operational behavior within wide limits without giving rise to new difficulties in the production of the machine. The design of the shape of the contour according to the present invention results in very slender gate rotor threads between the grooves thereof which, in turn, result in a significant increase in the effective working surface of the grooves relative to the diameter of the rotor. The problems of providing sealing between the crest portions of the threads of the gate rotor and the corresponding dedendum or root portions of the main rotor do not occur with the present invention due to the fact that the spaces which would otherwise correspond to the crest track sections existing in prior machine designs are practically eliminated.

The basic principles of the invention proceed from the fact that, when the crest portion of a rotor thread, which crest portion is located furthest from the axis of the rotor, is formed with a rounded configuration having a relatively small radius, then the profiled contour of the gate rotor threads will be defined, as viewed in cross section along a section extending perpendicularly to the axis of the rotor, by a plurality of circles each of which is tangent with both sides of the gate rotor thread, with each circle having a center which is located on a line extending radially outwardly of the gate rotor in a forward direction taken relative to the direction of rotor rotation when the machine is operated as a compressor. The diameter of each contour-defining circle of each of the gate rotor threads is smaller than the diameter of each circle which is located radially inwardly thereof and, thus, the circles decrease in diameter from a point radially inwardly of the gate rotor to a point radially outermost thereon. The center of the radially outermost circle which defines the crest or addendum portion of the gate rotor thread is located within and closely adjacent to the pitch circle of the gate or grooved rotor and the projecting length of the addendum of the gate rotor thread extending beyond the pitch circle corresponds approximately to the radius of the radially outermost circle of the series of circles which are used to define the contour of the gate rotor thread.

The invention further provides that the crest or addendum portion of the gate rotor thread which projects beyond the pitch circle of the gate rotor be peripherally shifted forwardly taken in the direction of rotor rotation. That is, the crest portion of the gate rotor thread will extend in a direction toward the trailing side of a groove relative to the intersecting point of the arc of the crest section with a pitch circle radius of the gate rotor, such radius extending through the middle of the arc of the pitch circle section. This results in that the crest points on the threads of the gate rotor and the main rotor which are most remote from the respective axes thereof will pass within a very short distance of each other and of an edge defined by the intersecting parallel bores of the machine housing so that, in this manner, a small blow hole is created. The rotary offset of the passage of the two rotors should be less than 9° with 2° to 3° being optimum. The angle of intersection of the contour of the thread flank of the gate rotor defining the leading groove side with the pitch circle radii lines of the gate rotor should be at least 4° and the distance of the intersecting points of the two flanks of the gate rotor thread with the pitch circle of the main rotor is advantageously between 3% and 12% of the diameter of the addendum circle of the main rotor.

The invention further provides that the radial distance from the pitch circle of a point on the contour of the crest portion of the gate rotor threads most remote from the axis and projecting beyond the pitch circle may be less than 2% of the diameter of the addendum circle of the main rotor. The pitch circle radii lines of the main rotor should at no point extend tangentially contiguous with the contours of the flank sides of the threads of the main rotor. As a result, the rotors may be satisfactorily produced and precise production thereof may be facilitated.

A further advantage of the invention may be derived in an embodiment thereof wherein a section of the gate rotor thread flank which defines the leading groove side and which begins at a dedendum point on the contour of the groove which is closest to the axis of the rotor has contact at least over one-third and preferably over one-half of its length with the flank of the main rotor thread if the point of the contour of the main rotor thread flank which is most remote from the axis has contact with the point of the contour of the gate rotor groove which is closest to the axis. Such a contour prevents the formation of so-called pockets, i.e. oblong compression spaces, which are difficult to fill and empty. Especially advantageous operating conditions are obtained when the area of a trapezoid which is defined by the end points of those diameters of the addendum circles of the rotors which are perpendicular in the axes of these rotors relative to the connecting line of these axes is between 60% and 78% of the sum of the areas of the addendum circles. The sum of the two angles always formed by two pitch circle radii lines extending through the edges of intersection of the bores of the machine housing should be 154° to 180°. This embodiment results in slender rotors with threads that are not too thin and which produce a high delivery output with small structural volume without endangering mechanical operating safety of the machine. In the selection of the number of threads or grooves of the rotors, especially advantageous conditions result when the difference between the number of grooves and the number of threads of both rotors is not more than 1 and when the sum of these numbers is at least 9, and preferably 11. Due to the small, uniform gradation of the pressures between the individual chambers of the machine obtained in this manner, a minimum leakage flow through the inevitable gaps between the chambers is achieved. In addition, large cross sections for discharge and admission can be achieved, and pressure variations in the discharge lines become smaller due to the fine pressure gradation. Furthermore, there is a reduction in the generation of noise.

When the shape of the contour of the flank section deviates from the exact pattern of the envelope curve, this deviating shape should, in accordance with the invention, occur at the respective longer flank section whose contour is determined by the shorter flank section of the other rotor, so that finishing tolerances will have as little effect as possible on the course of operation in the machine. Although heretofore, play has always been placed in a rotor, preferably the auxiliary rotor, in the present invention, the play is predominantly taken into consideration in the regions which are close to the axis, while the portions which are remote from the axis are produced exactly in accordance with the theoretical design.

As already mentioned, the features listed above will result in a large displaced volume per rotor rotation, since grooves with large cross sectional areas can be provided. A high delivery efficiency is obtained by reducing the size of the gap areas and by a flow-retarding design of the profile sections in the immediate vicinity of the gaps. This is especially true for the front gap at the high-pressure end of the rotors and for the gap between the radially outermost contours of the individual rotors and the cylindrical surfaces of the housing bores and, finally, for the gaps which form the blow hole. Furthermore, small friction and flow losses occur because large flow areas are available to the entering and discharging flows of the working medium. Since the contour or flank sections which come into contact with each other pose no difficulties with respect to production techniques, these sections can be finished especially carefully and, in this manner, they increase the operational safety of the machine and reduce the lubricating and cooling agent requirements as well as the leakage losses. Formation or production of the contours of the threads with reduced problems is, among other things, enabled by the fact that the entire contour pattern of the grooves and threads will have no edges and a relief cutting poses no problems because of the slender design of the gate rotor threads.

The invention makes it possible, with due consideration being given to the desired operating behavior of the machine, to predetermine the contour on a point-by-point basis and to arrange interpolation curves of a higher degree by means of adjacent, predetermined points of the contour in such a manner that the result is a shape which is as smooth as possible. The contour of the corresponding section of the other rotor which theoretically results as the envelope curve of the generating contour of the first rotor can, in the embodiment according to the invention, be modified in such a way that a low flow through the gap results with an advantageous force distribution. As previously described, deviations from the theoretical pattern of the contour required in this design may also be determined by predetermined points and by interpolation curves of higher degree. Accordingly, any number of profile sections can be computed in a given manner and the resulting contour will no longer be subject to the limitations which result from the predetermination of certain relatively simple geometric curves.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
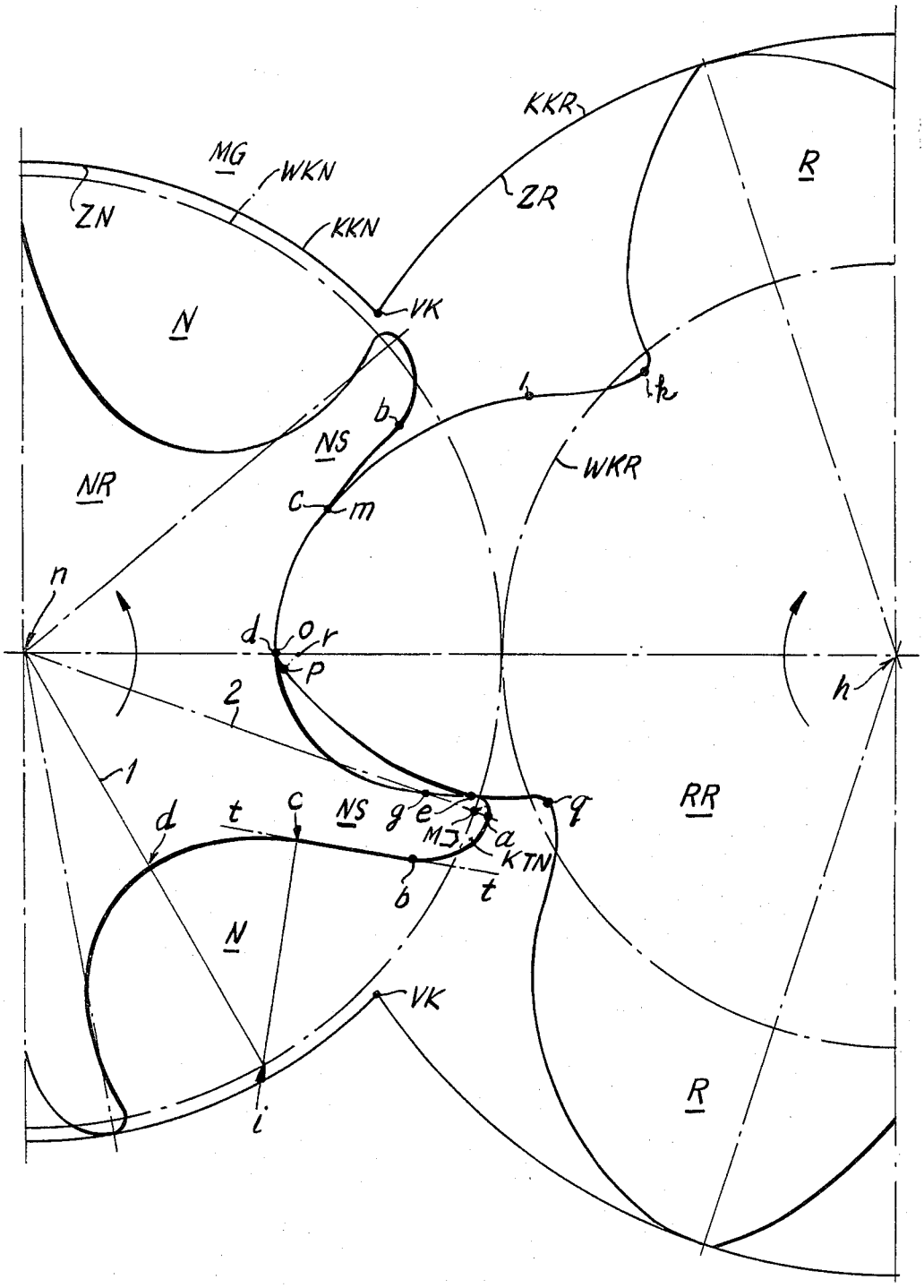
FIG. 1 is a schematic cross sectional representation of a screw rotor machine in accordance with the present invention.

Referring now to FIG. 1 of the drawings, the invention may be seen as applied in a screw rotor machine which includes a grooved or gate rotor NR and a ribbed or main rotor RR which are supported in a machine housing MG formed with a pair of intersecting cylindrical bores ZN and ZR, with the rotors being in meshed engagement through their threads or ribs R and their grooves N. The grooves N of the gate rotor NR are located essentially within a pitch circle WKN and the threads R of the main rotor RR are essentially located to extend outside of a pitch circle WKR of the main rotor.

Figure 2:
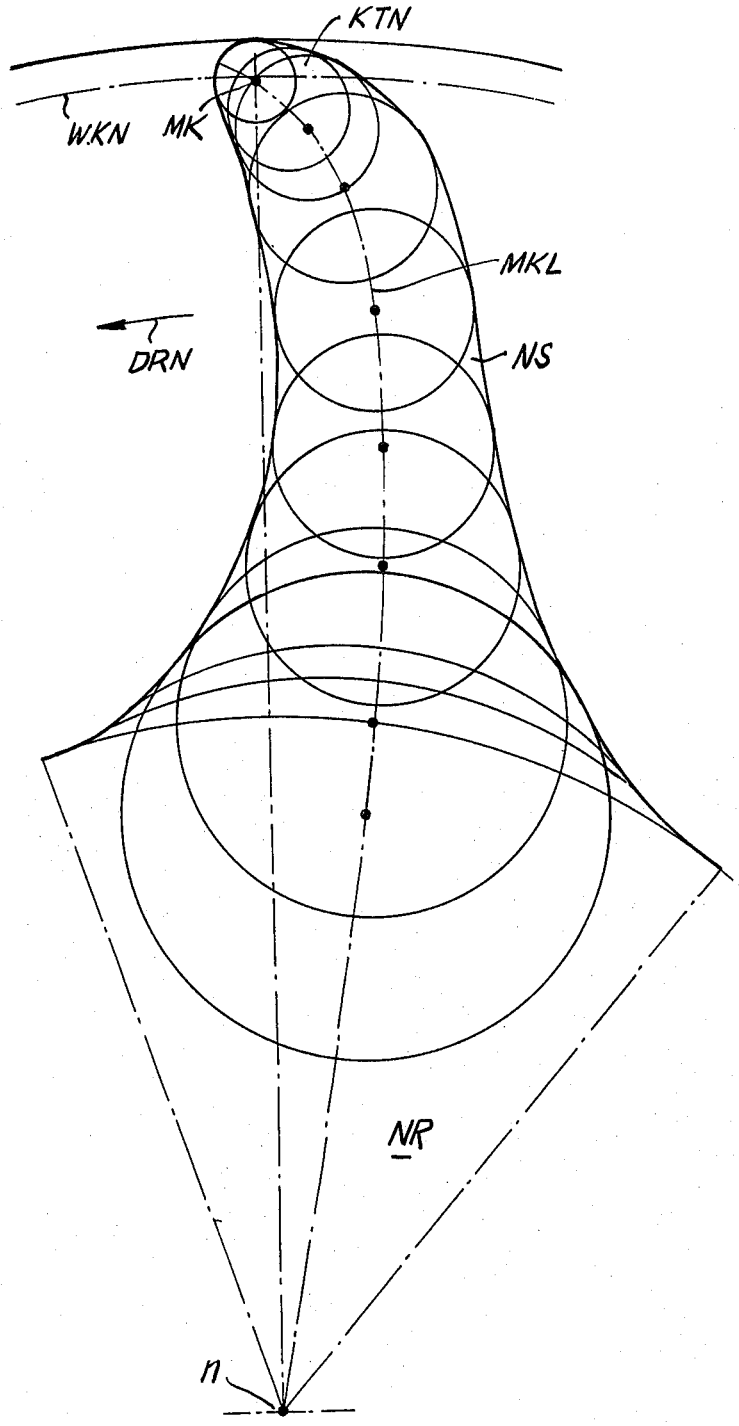
FIGS. 2–4 are schematic representations of details of the gate rotor thread of the screw rotor machine in accordance with the present invention as shown on an enlarged scale.

The main rotor thread R includes a crest section o-p which is located furthest from the axis of the main rotor RR and which is configured with a rounded contour having a small radius r. Each of the grooves N of the gate rotor NR has its opposite sides defined by flanks of the threads NS of the gate rotor NR. Each of the threads NS of the gate rotor NR is configured, as shown in FIG. 2, to have its flanks defined as tangents to a plurality of circles located along the radial length of the thread NS. The center of each of these circles is located upon a radial line MKL which is indicated in FIG. 2 in dash-dotted form and which is curved in a direction extending forwardly of the direction of rotation of the gate rotor NR when the screw rotor machine of the invention is operated as a compressor. The direction of rotation is indicated by the arrow DRN.

The diameters of each of the circles which define the flank contours of the gate rotor threads NS becomes smaller with further radially-outward location of the circle. The center MK of the radially outermost circle is located within the gate rotor pitch circle WKN and closely adjacent to this pitch circle. The projecting length of the crest portion KTN of the thread NS corresponds approximately to the radius of the circular, radially-outermost crest portion.

Referring to FIG. 1 wherein the direction of rotation is indicated by an arrow, the section of the leading side of the groove N of the gate rotor NR which begins at d located at a root portion of the gate rotor thread or of the gate rotor groove n which is closest to the axis, and which ends at c is a circular arc extending about the intersecting point i of the pitch circle radius 1 of the gate rotor NR and the pitch circle WKN of the gate rotor. The section of the flank which is connected to this flank section and which begins at c and ends at b is a line which is a tangent t to the circular arc d-c. The tangent t is simultaneously tangent to the subsequent circular arc which begins at b and extends tangentially into the rounded crest or addendum which forms the point a of the crest portion KTN of the thread NS of the gate rotor NR which is most remote from the axis thereof. The center MJ of the rounded crest portion is located within the pitch circle WKN on a pitch circle radius 2 which extends through the point a of the thread NS, which point a is most remote from the axis n of the gate rotor NR.

Figure 3:
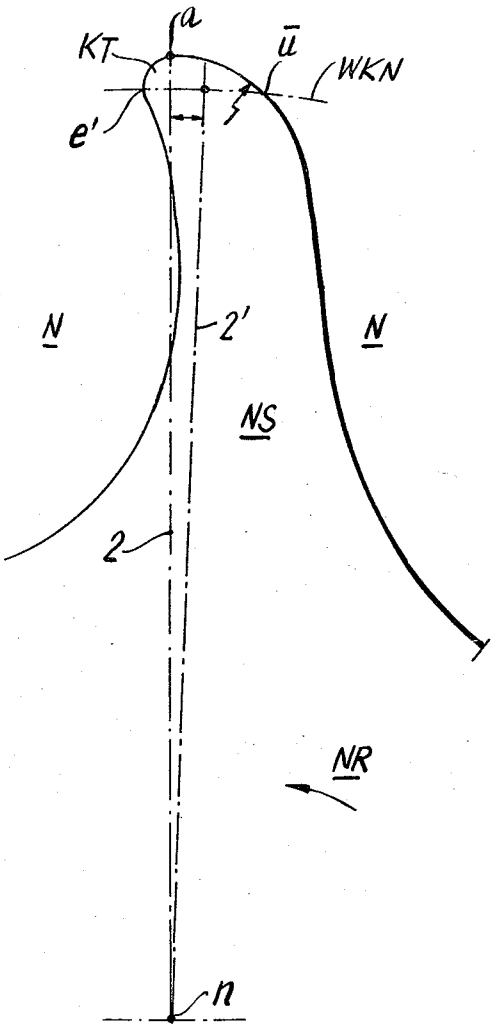

As illustrated in FIG. 3, the point a is located on the crest portion KTN of the thread NS which extends in a convex arc and which projects beyond the pitch circle WKN of the gate rotor. This point a is shifted peripherally forwardly taken relative to the direction of rotation of the rotor, and particularly toward the trailing side of the groove N, relative to the point of intersection between a pitch circle radius 2′ extending through the center of the arc of the corresponding pitch circle section e-u. The distance of the intersecting points e′ and u of the flanks of the thread NS with the pitch circle WKN of the gate rotor NR is approximately 3% to 12% of the diameter of an addendum circle KKR of the main rotor RR illustrated in FIG. 1, and the radial distance of the point a most remote from the axis of the contour of the crest portion KT of the thread NS projecting beyond the pitch circle WKN from this pitch circle WKN is less than 2% of the diameter of the addendum circle KKR of the main rotor RR. In the region of the pitch circle WKN, the rounded radius a-e leads into a section e-g of the trailing flank of the groove N which is generated by the aforementioned rounded crest portion o-p of the thread R of the main rotor RR as an envelope curve.

The flank section p-q of the thread R of the main rotor RR is generated as the envelope curve of the circular arc flank section a-e of the gate rotor thread NS. The section o-m beginning at the crest of the thread R is generated by the previously-described circular arc flank section d-c of the leading side of the groove N. The subsequent section m-l of the thread R is formed by the straight-line tangential flank section c-b of this groove side, and the section l-k is formed by the circular arc flank section b-a which follows the straight section c-b.

Figure 4:
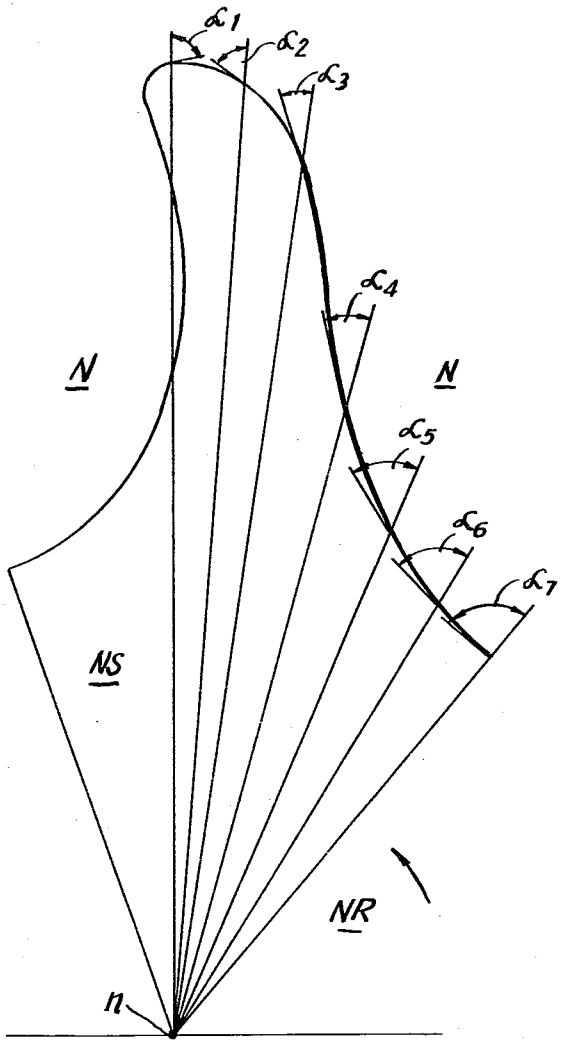

As shown in FIG. 4, each of the pitch circle radii extending from the center n of the gate rotor NR intersect the tangents of the trailing flank of the gate rotor thread NS, which is also the leading side of the gate rotor groove N at angles of intersection $\alpha_1$ to $\alpha_7$ which are at least 4°, and preferably 15° to 25° or more.

Figure 5:
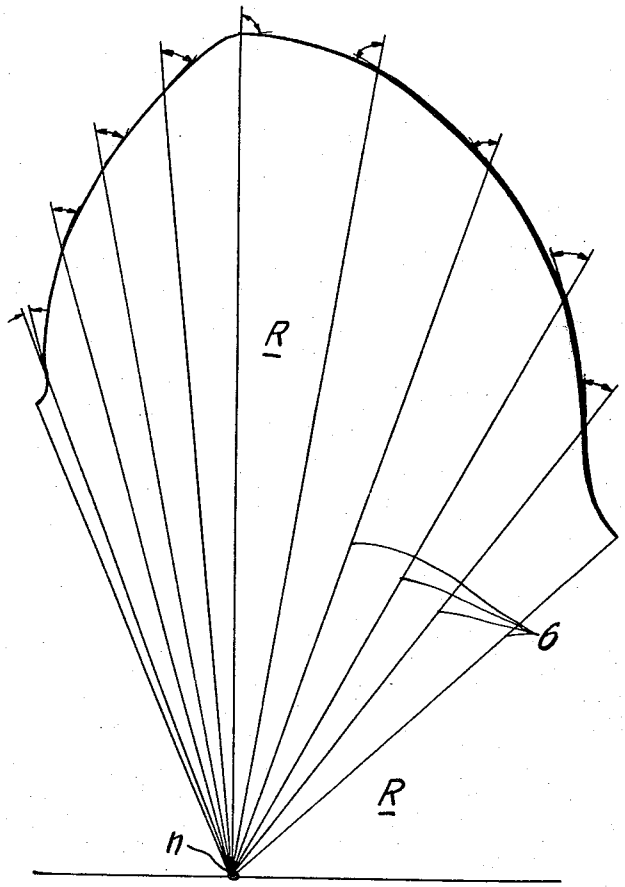
FIG. 5 is a schematic cross sectional representation of a main rotor thread shown on an enlarged scale.

In FIG. 5 all of the pitch circle radii 6 of the main rotor RR are shown as intersecting the contour of the thread flanks and it will be seen that they are nowhere tangent to the flank contours at any point.

Figure 6:
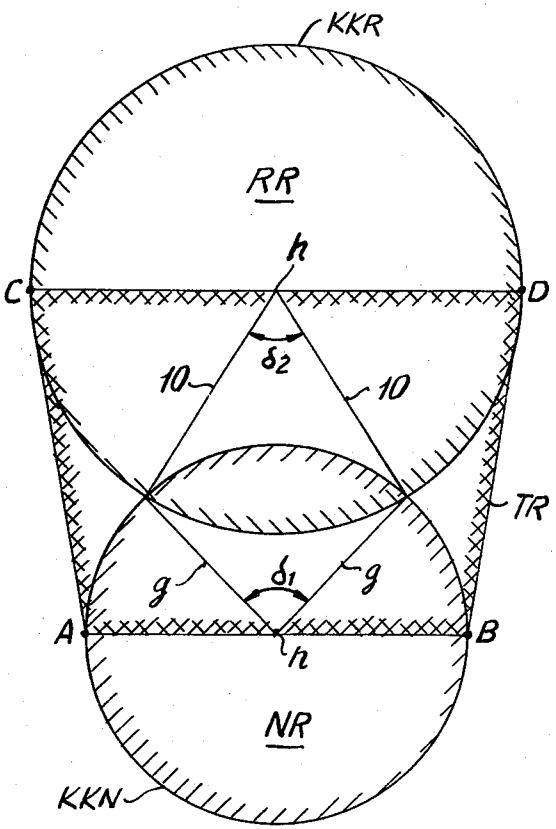
FIG. 6 is a geometric cross sectional diagram depicting certain dimensional aspects of the invention.

As indicated in FIG. 6, the area of a trapezoid TR having parallel sides AB and CD which are each formed by the diameters of the two addendum circles KKN and KKR of the gate rotor NR and the main rotor RR which are perpendicular to the connecting lines between the two axes n and h of the rotors is between 60% and 78% of the sum of the area of the addendum circles KKN and KKR.

Furthermore, the sum of the two angles $\delta_1$ and $\delta_2$ formed by the addendum circle radii 9 and 10 extending through the intersecting edges VK of the bores of the machine housing (not shown in this Fig.) is approximately 154° to 180°.

Figure 7:
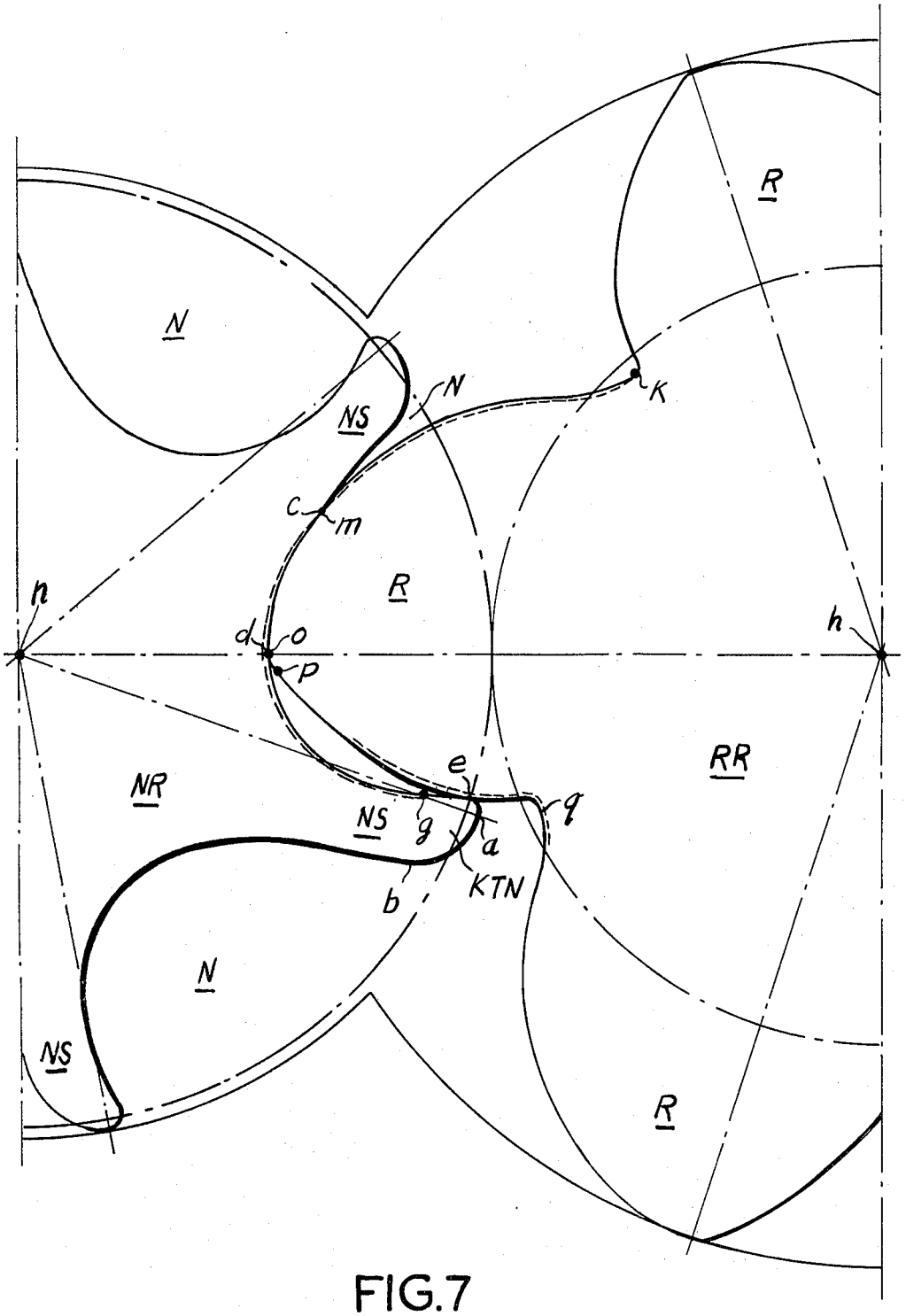
FIG. 7 is a schematic cross sectional representation of details of the rotors of the screw rotor machine of the invention when the shape of the contour of a flank section deviates from the exact pattern of the envelope curve.

FIG. 7 shows that when the shape of the contour of a flank section deviates from the exact pattern of the envelope curve that the shape deviation of the contour of the flank section c-d of the leading side of the groove N is generated by the flank section o-m of the thread R, and the deviating shape of the long flank section d-g of the groove N is generated by the short flank section o-p of the thread R. The deviating shape of the long flank section p-q of the thread R is generated by the short flank section a-e of the crest portion KT of the threads NS of the gate rotor NR, and the deviating long flank section m-k of the thread R is generated by the flank section c-b and b-a of the threads NS of the gate rotor NR.

Figure 8B:
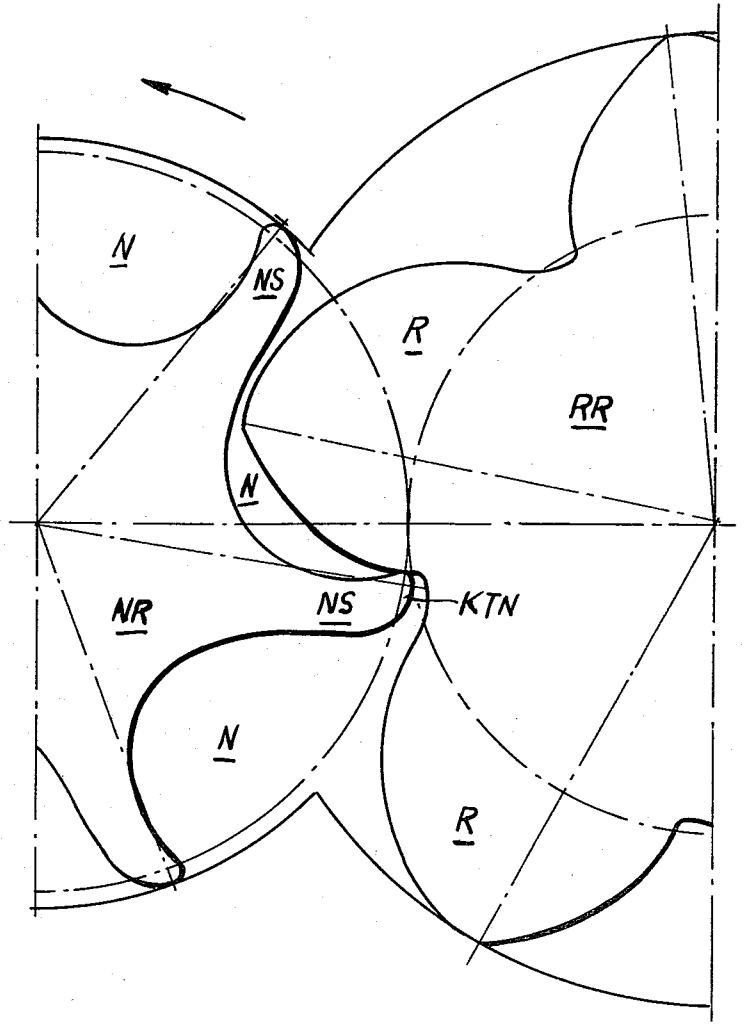
FIGS. 8*a*–8*f* and 9 are schematic cross sectional representations showing, respectively, details of the rotating interaction between the rotors of the screw rotor machine.
Figure 8A:
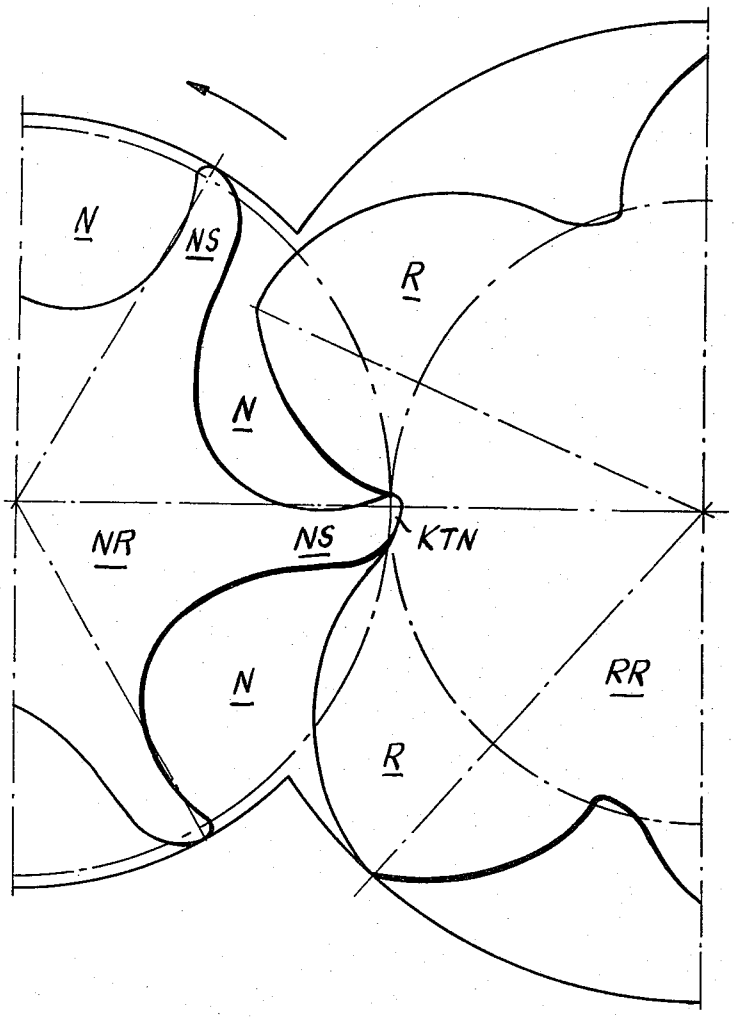
Figure 8D:
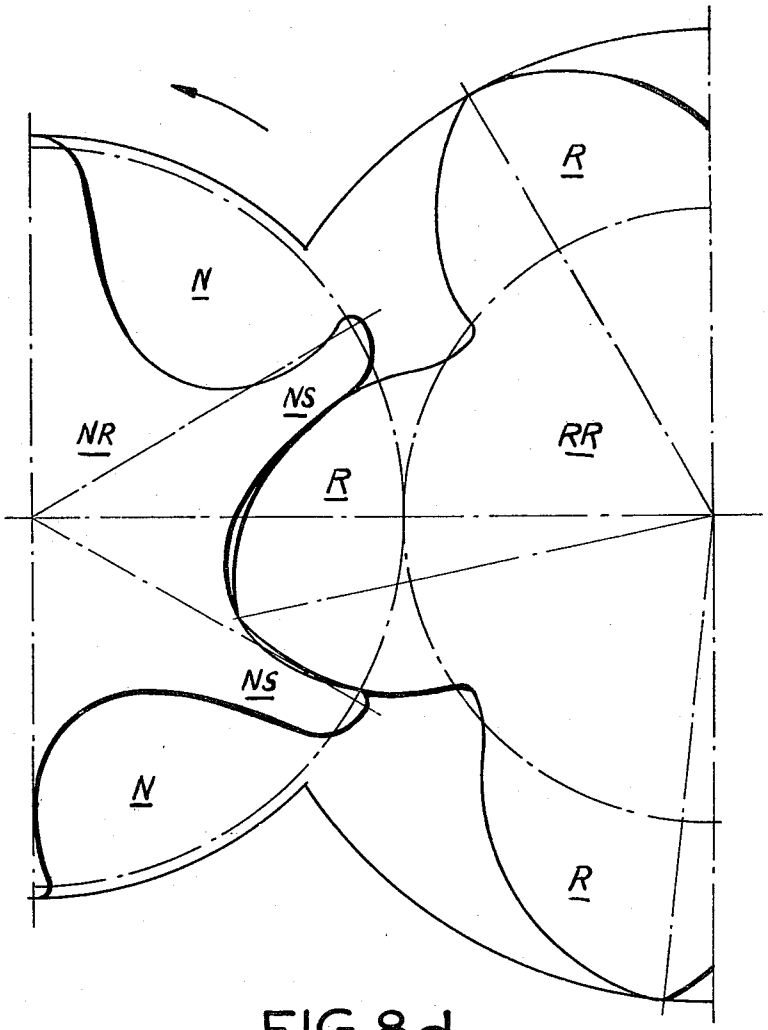
Figure 8C:
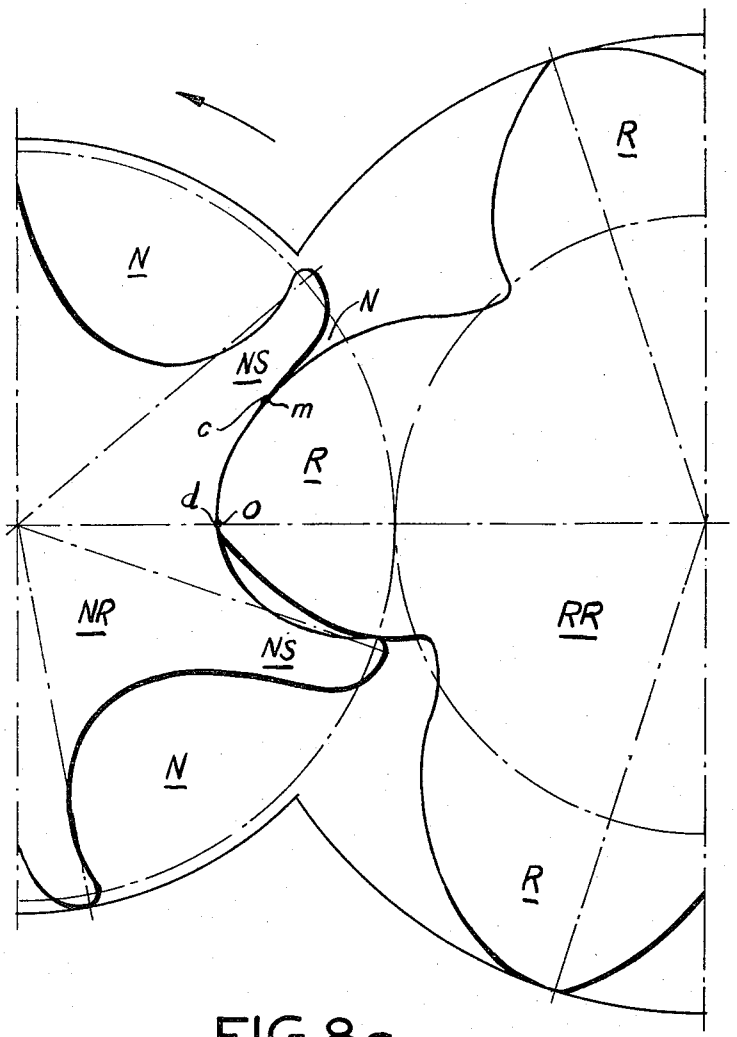
Figure 8F:
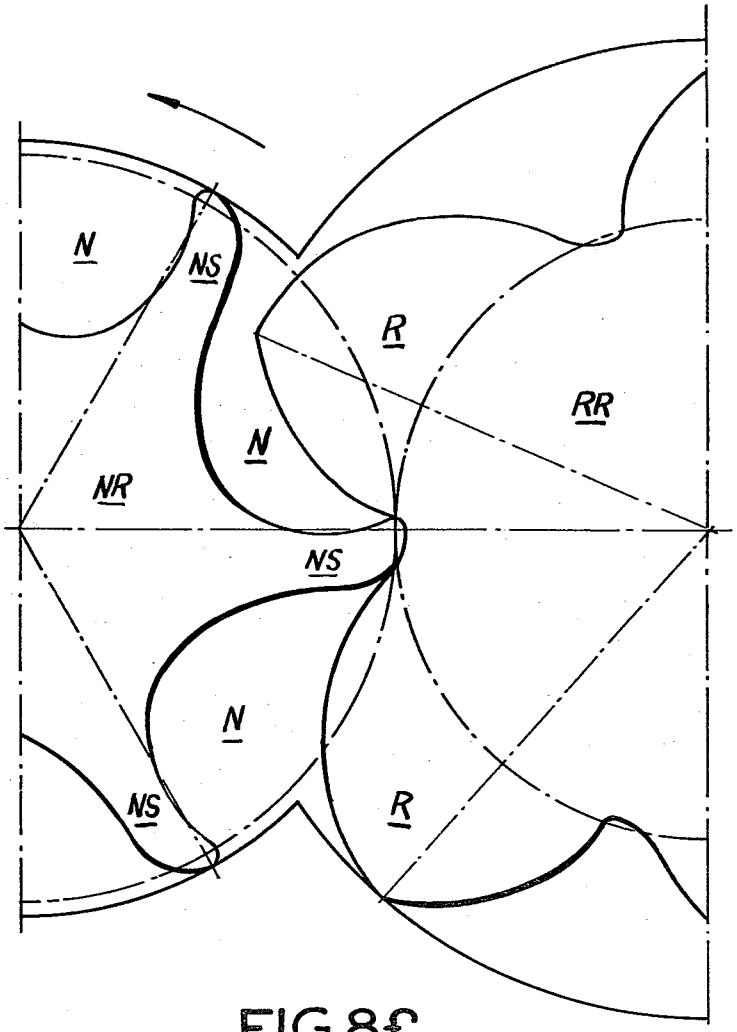
Figure 8E:
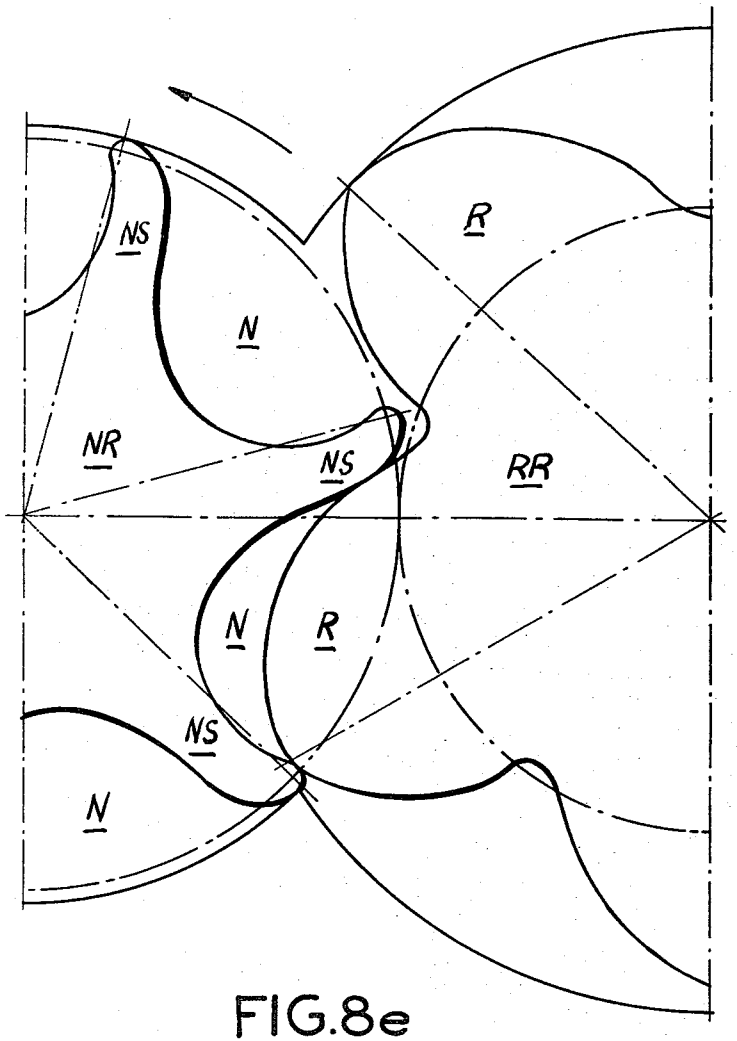

As will be seen in FIGS. 8*a* to 8*f*, the rolling interaction between the sides of the grooves and the threads illustrates, particularly in FIGS. 8*a* and 8*b* that the contour of the crest portion KT of the thread NS of the gate rotor insures a satisfactory seal between the sides of the grooves and the threads when the crest portion moves through the transition region close to the axis between the thread R of the main rotor RR and, further, that the gap areas are very small and the flank sections forming the profile extend in a manner favorable to the flow in the immediate vicinity of the gaps. FIG. 8*c* shows especially clearly that a flank section d-c of the leading groove sides beginning at the point d of the groove N closest to the axis has contact with the flank section o-m of the thread R of the main rotor RR at least over a third, and preferably over one-half of the length of this flank section when the point o of the main rotor thread flank which is most remote from the axis is in contact with the point d of the groove N which is closest to the gate rotor axis.

Figure 9:
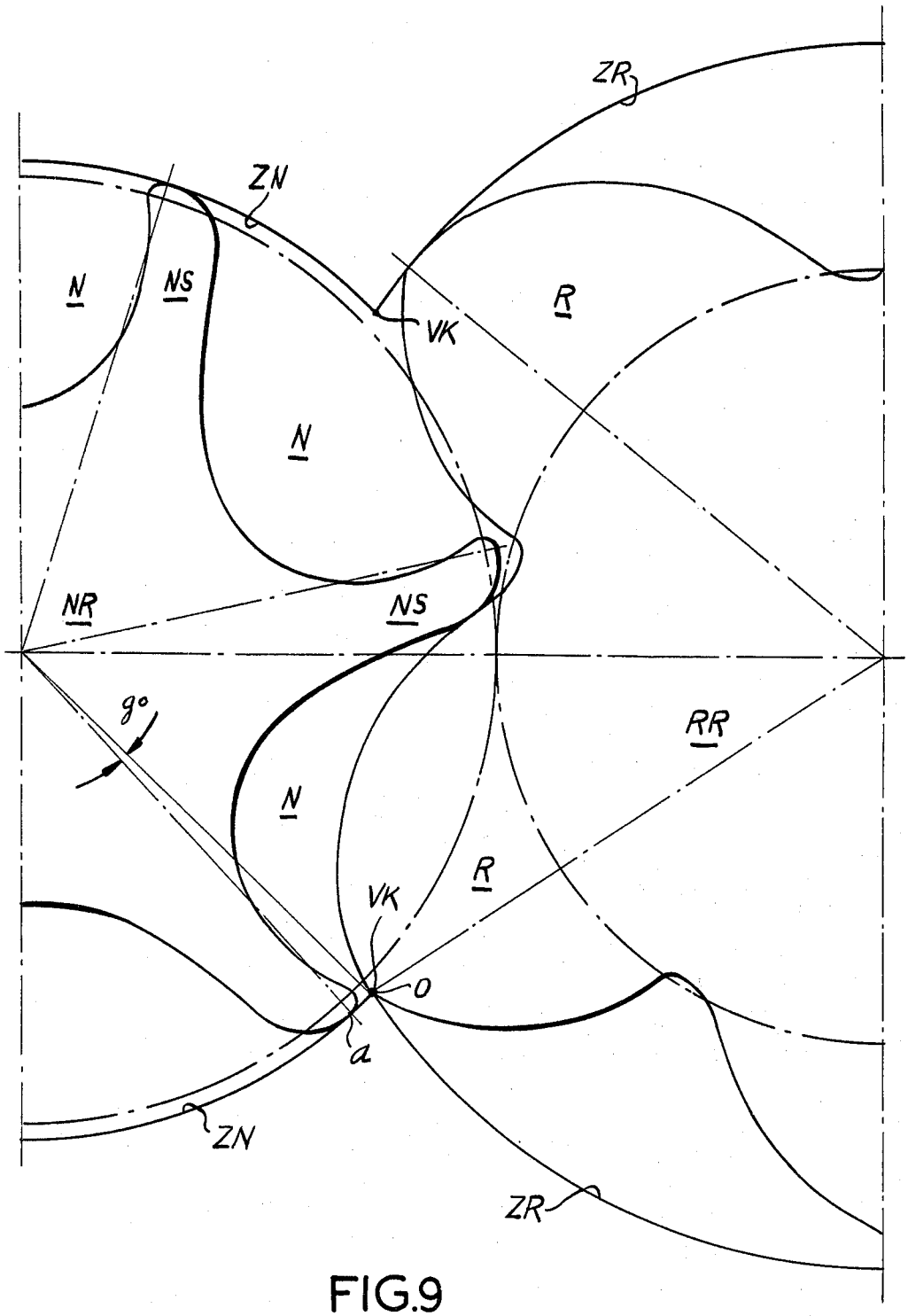
Figure 10:
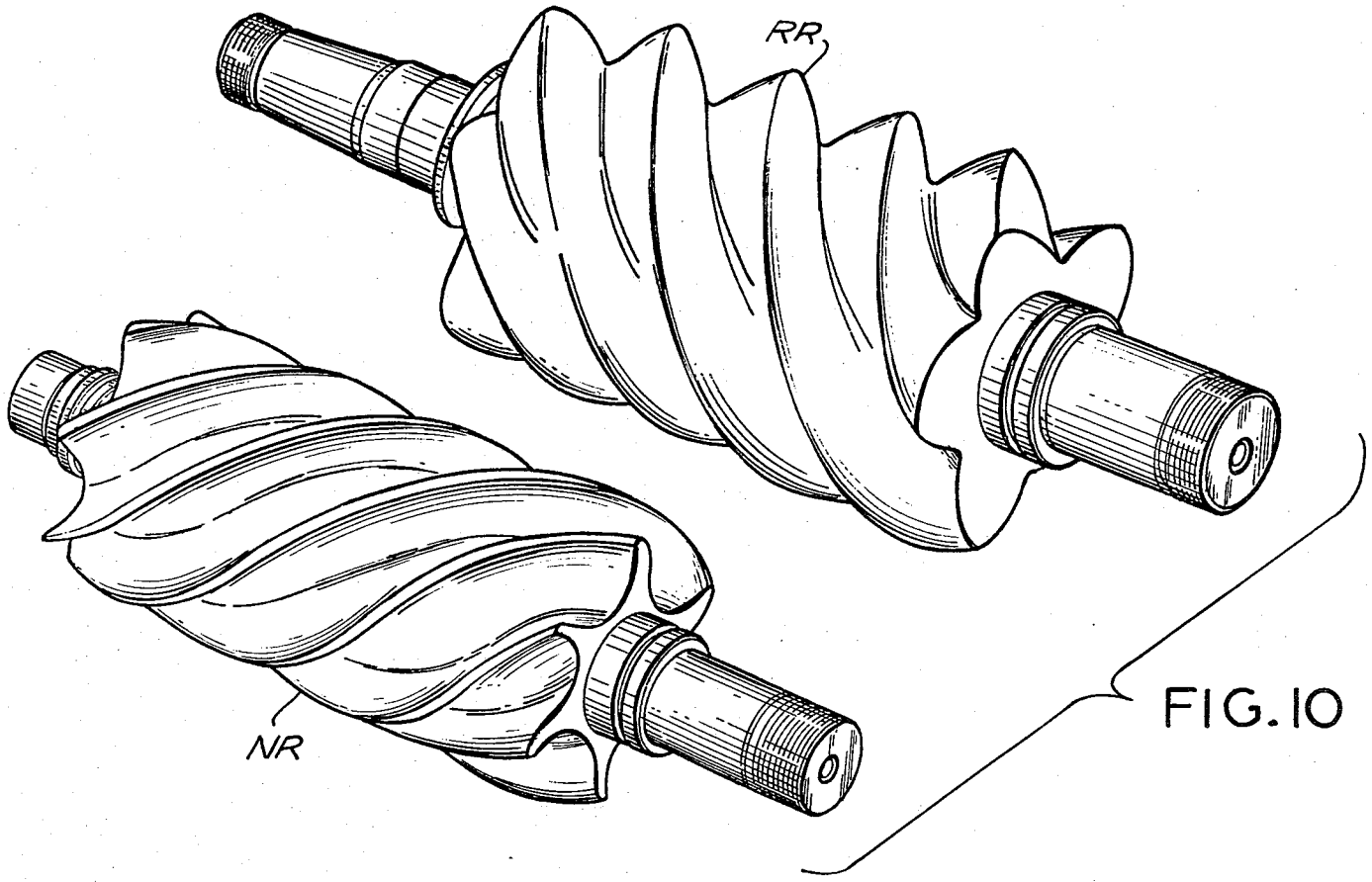
FIG. 10 is a perspective view showing the rotors of the screw rotor machine in accordance with the present invention.

FIG. 9 shows that the distances of the points o of the thread R of the main rotor RR, and subsequently of the points a of the thread NS of the gate rotor NR, the points o and a each being the points most remote from the axes, determine a rotary offset of the main rotor RR relative to the gate rotor NR of approximately 9° during successive passing of the intersecting edge VK of the two intersecting bores ZN and ZR of the machine housing MG.

While specific embodiments of the invention have been shown and described in detail to illustrate the application of the inventive principles, it will be understood that the invention may be embodied otherwise without departing from such principles.

What is claimed is:

1. In a screw rotor machine including a housing defining a pair of intersecting parallel bores, and a pair of rotors mounted for rotation within said bores of said housing, said rotors having intermeshing helical threads and grooves, with the threads and grooves of one of said rotors lying substantially outside the pitch circle of said one rotor and with the threads and grooves of the other of said rotors lying substantially inside the pitch circle of said other rotor, said threads of said other rotor including a crest portion located substantially outside the pitch circle of said other rotor, with flanks of the threads of said other rotor defining, respectively, one side each of adjacent grooves located on opposite sides of said thread, one of said flanks of said threads of said other rotor operating to define the side of an adjacent groove which is the trailing side of said groove when said machine is operated as a compressor and the leading side when said machine is operated as a motor, said trailing side of said groove being substantially generated from a point in said groove closest to the axis of said other rotor to a point where said groove intersects the pitch circle of said other rotor by a crest portion of the respective thread of said one rotor which is radially most remote from the axis of said one rotor, the improvement which comprises that said radially remote crest portion of said one rotor is rounded with a relatively small radius dimension to generate the flanks of the threads of said other rotor to be tangent to a plurality of circles having centers which lie on a radial line which is curved in the direction of rotation of said other rotor, said circles having diameters which decrease taken from the radially innermost to the radially outermost of said circles, with said crest portion of said threads of said other rotor being shaped in conformity with the radially outermost of said plurality of circles, said radially outermost circle having a center which is located within and closely adjacent to the pitch circle of said other rotor, said crest portion thereby projecting beyond said pitch circle of said other rotor a distance corresponding approximately to the radius of said outermost circle.

2. A screw rotor machine according to claim 1 wherein the point most remote from the axis of the contour extending in a convex arc of said crest portion of said thread of said other rotor projecting beyond the pitch circle of said other rotor is peripherally shifted in the direction of the trailing side of said groove relative to the intersecting point of this arc with a pitch circle radius of said other rotor extending through the center of the arc of the pitch circle section.

3. A screw rotor machine according to claims 1 or 2 wherein the angles of intersection of the contour of said leading groove side with the pitch circle radii of said other rotor are at least 4°.

4. A screw rotor machine according to claim 3 wherein said angles of intersection are between 15° and 20°.

5. A screw rotor machine according to claims 1 or 2 wherein the distance of the intersecting points of two groove sides forming said thread of said other rotor from the pitch circle of said other rotor is between 3% and 12% of the diameter of the addendum circle of said one rotor.

6. A screw rotor machine according to claims 1 or 2 wherein the radial distance of a point most remote from the axis of the contour of said crest portion of said thread of said other rotor projecting beyond the pitch circle of said other rotor from this pitch circle is less than 2% of the diameter of the addendum circle of said one rotor.

7. A screw rotor machine according to claims 1 or 2 wherein the pitch circle radii of said one rotor are devoid of tangential contact with any point on the flanks of the threads of said one rotor.

8. A screw rotor machine according to claims 1 or 2 wherein said leading side of said groove of said other rotor includes a section beginning at a point on the contour of said groove closest to the axis of said rotor which has contact with a flank of the thread of said one rotor over at least one-third the length of said groove side, with the point on the flank of said thread of said one rotor which is most remote from the axis of said one rotor having contact with the point on said groove contour which is closest to the axis of said other rotor.

9. A screw rotor machine according to claim 8 wherein said contact extends over one-half the length of said side.

10. A screw rotor machine according to claims 1 or 2 wherein the area of a trapezoid whose sides extend between the end point of a pair of parallel diameters of the addendum circles of said one and said other rotors, said diameters extending through the axes, respectively, of said rotors is between 60% and 78% of the sum of the areas of the addendum circles of each of said one and said other rotors.

11. A screw rotor machine according to claims 1 or 2 wherein the sum of two angles formed, respectively, by pitch circle radii extending from the centers of each of said one and said other rotors and intersecting the edges formed by said intersecting parallel bores of said housing is between 150° and 180°.

12. A screw rotor machine according to claims 1 or 2 wherein the sum of the number of threads formed on both said one and said other rotor is at least 9 and wherein the difference between the number of threads formed on each rotor is not more than 1.

13. A screw rotor machine according to claims 1 or 2 wherein the contour of the flank of the thrad of either of said one and said other rotor deviates from the exact pattern of the respective envelope curve, this deviation in contour changing always that flank side whose contour is determined by the flank section of the opposite rotor.

14. A screw rotor machine according to claims 1 or 2 wherein said rotors are arranged with a rotary offset therebetween determined by the distance between a pair of points which are located radially outermost from the axis of each rotor on the crest portion of the threads thereof respectively during successive passing of said outermost points by an intersecting edge of said pair of intersecting parallel bores of said housing, and wherein said rotary offset is less than 9°.

15. A screw rotor machine comprising:

a housing defining a pair of intersecting parallel bores; a main rotor and a gate rotor each defining a pitch circle and each being mounted for rotation, respectively, within said bores of said housing;

intermeshing helical threads and grooves formed, respectively, on said main rotor and said gate rotor, said threads and grooves of said main rotor lying substantially outside said main rotor pitch circle, said threads and grooves of said gate rotor lying substantially inside said gate rotor pitch circle, said main rotor threads having opposed flanks formed with a generally convex profile, said gate rotor threads having opposed flanks formed with a generally concave profile; and a rounded crest portion on said main rotor threads generating said flanks of said gate rotor threads as tangents to a plurality of circles having progressively decreasing diameters taken from the radially innermost to the radially outermost of said plurality of circles;

said circles having centers which lie on a curved radial line directed forwardly of the direction of rotation of said gate rotor when said machine is operated as a compressor.

16. A screw rotor machine according to claim 15 wherein said gate rotor threads comprise a crest portion shaped in conformity with said radially outermost of said plurality of circles, with the center of said radially outermost circle lying within and closely adjacent to said gate rotor pitch circle, said crest portion projecting outside said gate rotor pitch circle a distance corresponding approximately to the radius of said radially outermost circle.

17. A screw rotor machine according to claim 15 wherein the radially outermost point of said crest portion on said gate rotor threads is located forwardly, taken relative to the rotative direction of said gate rotor when said machine is operated as a compressor, of the point of intersection of a gate rotor pitch circle radius and the center of a pitch circle arc extending between the points of intersection of said gate rotor pitch circle with the opposite flanks of said gate rotor threads.

18. A screw rotor machine according to claims 15, 16 or 17 wherein the angles of intersection between lines extending tangent to the trailing flank of said gate rotor threads and gate rotor pitch circle radii intersecting said tangent lines at the point of tangency thereof are not less than 4°.

19. A screw rotor machine according to claim 18 wherein said angles of intersection are between 15° and 20°.

20. A screw rotor machine according to claims 15, 16 or 17 wherein said main rotor defines an addendum circle and wherein the distance between the points of intersection of said gate rotor pitch circle and the opposite flanks of said gate rotor threads is between about 3% to 12% of the diameter of said addendum circle of said main rotor.

21. A screw rotor machine according to claim 20 wherein said crest portion of said gate rotor thread projects radially outwardly beyond the pitch circle of said gate rotor a distance less than 2% of the diameter of said addendum circle of said main rotor.

* * * * *